US007865271B2

(12) United States Patent
Booth et al.

(10) Patent No.: US 7,865,271 B2
(45) Date of Patent: Jan. 4, 2011

(54) METHODS AND SYSTEMS TO INCREASE EFFICIENCY AND REDUCE FOULING IN COAL-FIRED POWER PLANTS

(75) Inventors: Michael Booth, Norcross, GA (US); Dean Draxton, Park City, UT (US); Roy Payne, Mission Viejo, CA (US)

(73) Assignee: General Electric Company, Schenectady, NY (US)

( * ) Notice: Subject to any disclaimer, the term of this patent is extended or adjusted under 35 U.S.C. 154(b) by 461 days.

(21) Appl. No.: 11/591,844

(22) Filed: Nov. 2, 2006

(65) Prior Publication Data

US 2008/0105175 A1 May 8, 2008

(51) Int. Cl.
*G05D 7/00* (2006.01)

(52) U.S. Cl. ..... 700/282; 700/287; 700/299; 431/12; 702/182; 110/347

(58) Field of Classification Search ..... 700/282, 700/287, 299; 431/12; 702/182; 110/347
See application file for complete search history.

(56) References Cited

U.S. PATENT DOCUMENTS 4,692,319 A * 9/1987 Farago et al. ..... 423/243.03
4,838,185 A * 6/1989 Flament ..... 110/347
5,195,450 A * 3/1993 Marion ..... 110/347
5,343,820 A * 9/1994 Marion ..... 110/264
5,899,172 A * 5/1999 Dallen et al. ..... 122/4 D
5,915,310 A * 6/1999 Hura et al. ..... 110/345
6,007,325 A * 12/1999 Loftus et al. ..... 431/8
6,123,910 A * 9/2000 Yoshii et al. ..... 423/235
6,138,588 A * 10/2000 Chapman et al. ..... 110/347
6,280,695 B1 * 8/2001 Lissianski et al. ..... 423/239.1
7,147,461 B2 * 12/2006 Neary ..... 431/5
2004/0185399 A1 * 9/2004 Moberg ..... 431/4
2004/0244367 A1 * 12/2004 Swanson et al. ..... 60/295
2005/0177340 A1 * 8/2005 Draxton et al. ..... 702/182
2006/0015778 A1 1/2006 Widmer et al.
2006/0136161 A1 * 6/2006 Draxton et al. ..... 702/100
2008/0011109 A1 * 1/2008 Bourgein ..... 73/865.9

OTHER PUBLICATIONS

"Marco and Micro-Pollutant Emission Reduction in Coal-Fired Power Plant", Marca et al, Enel S.p.A., Generation Division, 2003.*

* cited by examiner

*Primary Examiner*—Michael D Masinick
(74) *Attorney, Agent, or Firm*—Mark E. Henderson; Ernest G. Cusick; Frank A. Landgraff

(57) ABSTRACT

A system for reducing fouling and improving efficiency in a coal-fired power plant that may include: 1) an analyzer grid, the analyzer grid including a plurality of sensors that measure gas characteristics through an approximate cross section of a flow through a boiler of the coal-fired power plant; 2) a plurality of air injectors with enhanced controllability; 3) means for analyzing the measurements of the gas characteristics; and 4) means for controlling the air injectors with enhanced controllability. The analysis of the measurements of the gas characteristics may include analyzing the measurements to determine zones of non-homogeneous flow.

12 Claims, 2 Drawing Sheets

METHODS AND SYSTEMS TO INCREASE EFFICIENCY AND REDUCE FOULING IN COAL-FIRED POWER PLANTS

TECHNICAL FIELD

This present application relates generally to methods and systems for increasing efficiency and reducing fouling in coal-fired power plants. More specifically, but not by way of limitation, the present application relates to methods and systems for increasing efficiency and reducing fouling in tangential coal-fired boilers.

BACKGROUND OF THE INVENTION

Boiler slagging (i.e., the depositing of ash on convective surfaces) may cause fouling issues in the convective pass of coal-fired power plants and remains a significant issue to many utility companies. The problem is often initiated in a particular locus of the inlet cross section because of temperature and $O_2$/CO imbalances. This is especially true for tangential coal-fired boilers designed for Eastern bituminous coals that are now burning coals with constituents that cause them to have lower ash softening temperatures. For such boilers and fuels, which are already likely to operate with fouling issues, installation of conventional low-NOx burners may exacerbate fouling issues by a substantial degree. This often results in the need to operate at low loads periodically to "drop slag," which may cause a loss in revenue to the power plant. Further, increases in fouling may result in tube leaks and repair expense therefor, or in forced outages to clean the convective pass of the collected slag. Current slag control generally is a reactive process, with the focus upon attempting to clean/control the result of poor balance and distributions within the system.

In general, a tangentially-fired boiler furnace has four to nine levels of burners that inject fuel and air from each corner at a tangent to an imaginary circle drawn within the boiler. The original designers of these boilers assumed that the resulting fireball would be a homogeneous structure. However, this desired result has not been achieved in conventional systems, and the reasons for this are several. First, the air supply to the burners is regulated for the four burners on each level as a group, i.e., there is no separate air supply control for each individual burner. Second, fuel supply to each burner is inconsistent as flows tend to vary from burner pipe to burner pipe because of the nature of the fuel distribution system. These two factors lead to imbalances in the delivery of air and fuel. The result is that instead of a homogeneous burning mass, the burner array produces a series of burner flow fields that resemble an intertwining series of rising helixes, as discussed in more detail below.

Because of the air and fuel supply inconsistencies, velocities and temperatures in individual flow fields that develop often differ. Stoichiometries may vary as well, with the result that some flow fields are fuel lean, while others are fuel-rich. These imbalances often create conditions in which ash softening occurs in the convective section, which causes the depositing of ash on the convective surfaces. More specifically, a fuel-rich flow field (i.e., reducing atmosphere) may reach an ash softening temperature at a significantly lower temperature than a balanced or fuel lean flow field, thus increasing the likelihood of ash softening (and slag formation) in the convective section of the boiler. Temperature imbalances further mean that high temperature zones exist, which further increases the likelihood that the ash softening temperature is reached and slag forms.

Conventional systems have no ready means to diagnose or address this problem. This is particularly true in boilers designed for Eastern Bituminous coal that are now burning Western coals such as PRB. The problem is further exacerbated with the installation of conventional low-NOx burners, which operate at even lower average stoichiometries in the main combustion zone.

At present, boiler operators pay little heed to the balance of stoichiometries and temperature and their effect on slagging. Most operators, specifically on tangentially-fired boilers, have come to accept the imbalances as being "normal" for the type of boiler. Current slag control, therefore, becomes substantially a reactive process, with the focus upon attempting to clean/control the result of poor balance and distributions. As described, addressing slagging issues in this manner is inefficient and costly. Further, as one of ordinary skill in the art would appreciate, stoichiometry imbalances within the boiler cause system inefficiencies.

Thus, there is a demonstrated need for a system and method for proactively mitigating slag formation or fouling in boilers, especially tangentially coal-fired boilers. A system and method that achieved this goal while also increasing boiler efficiency would be particularly valuable to boiler operators. One such system may prevent or significantly reduce slag formation and increase efficiency by addressing the flow field imbalances that occur in conventional systems throughout the furnace. As described, when present, flow field imbalances lead to stoichiometric and temperature imbalances in the convective section of the boiler such that temperatures above ash softening points are experienced and ash is deposited on convective surfaces. There is a need for such a system to operate without sacrificing the NOx reductions made possible by the enhanced staging capabilities of the low NOx firing configuration.

Further, conventional set-up of tangential coal fired plants make the avoidance of such flow field imbalances within the furnace potentially difficult and costly. As such, there is a need for an improved system and method that is effective at avoiding such imbalances while being simple, such that it may be implemented in a cost effective manner in new boilers and/or retrofitted in existing boilers. It has been discovered that such a system and method may utilize effective zonal monitoring to drive a limited number of air injector nozzles in the upper furnace so as to mitigate zones of both high temperature gas and zones of fuel-rich flow fields prior to their entry into the convection pass where slag formation may occur.

BRIEF DESCRIPTION OF THE INVENTION

The present application thus describes a system for reducing fouling and improving efficiency in a coal-fired power plant that may include: 1) an analyzer grid, the analyzer grid including a plurality of sensors that measure gas characteristics through an approximate cross-section of a flow through a boiler of the coal-fired power plant; 2) a plurality of air injectors with enhanced controllability; 3) means for analyzing the measurements of the gas characteristics; and 4) means for controlling the air injectors with enhanced controllability. In some embodiments, the analysis of the measurements of the gas characteristics may include analyzing the measurements to determine zones of non-homogeneous flow.

The system further may include means for controlling the air injectors with enhanced controllability so that the zones of non-homogeneous flow are disrupted and a more homogeneous flow throughout the cross-section of flow is realized. The control of the air injectors with enhanced controllability may be based on the analysis of the measurements of gas characteristics. The gas characteristics measured by the sensors include at least one of CO, $O_2$ and temperature levels.

Summing the number of air injectors with enhanced controllability with a number of air injectors without enhanced controllability provides a total number of air injectors. In some embodiments, the percentage of the total number of air injectors that are air injectors with enhanced controllability may be less than or equal to about 30%. In other embodiments, the percentage of the total number of air injectors that are air injectors with enhanced controllability may be less than or equal to about 20%. The analysis of the measurements of the gas characteristics may include analyzing the measurements to determine the extent to which zones within the cross-section of flow have differing CO, $O_2$, and temperature levels.

In some embodiments, controlling the air injectors with enhanced controllability based the analysis may include controlling the air injectors with enhanced controllability such that the differing CO, $O_2$, and temperature levels between the zones of the cross-section of flow are minimized. The air injector with enhanced controllability may include an air injector with at least one of tilt control, yaw control and air quantity control. The coal-fired power plant may be a tangential coal-fired power plant.

In some embodiments, the analyzer grid may be positioned in a convective stage of a boiler and may include sensors that are substantially evenly spaced over the approximate cross-section of flow. The air injectors with enhanced controllability may include two of the air injectors of two ports within a separated overfire air injector port level, two of the air injectors within a close-coupled overfire air injector port level, and two of the air injectors within a top burner level. In other embodiments, the air injectors with enhanced controllability may include two of the air injectors within a separated overfire air injector port level and two of the air injectors within a close-coupled overfire air injector port level. In some embodiments, the air injectors of the separated overfire air injector port level and the close-coupled overfire air injector port level are located at the corners of a substantially rectangular furnace, and the two air injectors with enhanced controllability within each of the port levels may include the air injectors positioned on opposite corners of the rectangle.

The application may further describe a method for reducing fouling and improving efficiency in an tangential coal-fired power plant that includes the steps of: 1) measuring the gas characteristics through an approximate cross-section of a flow through a convective stage; 2) analyzing the measurements of the gas characteristics to determine zones of non-homogeneous flow; and 3) controlling a plurality of air injectors with enhanced controllability such that the zones of non-homogeneous flow are disrupted and a more homogeneous flow throughout the cross-section of flow is realized. The measuring the gas characteristics through an approximate cross-section of a flow through a convective stage may include measuring CO, $O_2$ and temperature levels.

In some embodiments, the step of analyzing the measurements of the gas characteristics to determine zones of non-homogeneous flow may include analyzing the measurements of gas characteristics to determine the extent to which the zones of non-homogeneous flow within the cross-section of flow have differing CO, $O_2$, and temperature levels. The step of controlling a plurality of air injectors with enhanced controllability such that the zones of non-homogeneous flow are disrupted and a more homogeneous flow throughout the cross-section of flow is realized may include controlling the air injectors with enhanced controllability such that the differing CO, $O_2$, and temperature levels in the zones of non-homogeneous flow through the cross-section of flow are minimized.

In some embodiments, the step of controlling the air injectors with enhanced controllability such that the differing CO, $O_2$, and temperature levels in the zones of the cross-section of flow are minimized includes the steps of: 1) making a first adjustment to the air injectors with enhanced controllability; 2) determining the effect of the first adjustment by analyzing the measurements taken of the gas characteristics taken after the first adjustment; and 3) making a second adjustment to the air injectors with enhanced controllability based on the effect of the first adjustment. In some embodiments, the air injector with enhanced controllability includes an air injector with at least one of tilt control, yaw control, and air quantity control.

These and other features of the present application will become apparent upon review of the following detailed description of the preferred embodiments when taken in conjunction with the drawings and the appended claims.

DETAILED DESCRIPTION OF THE INVENTION

It has been discovered that fouling or slag formation in coal-fired boilers may be significantly reduced or mitigated through avoiding stoichiometry and temperature imbalances that form in the furnace and carry into the convective stages. In fact, the avoidance of either element will significantly mitigate the development of problematic slagging. Further, as one of ordinary skill in the art will appreciate, the avoidance of these imbalances will increase boiler efficiency.

Figure 1:
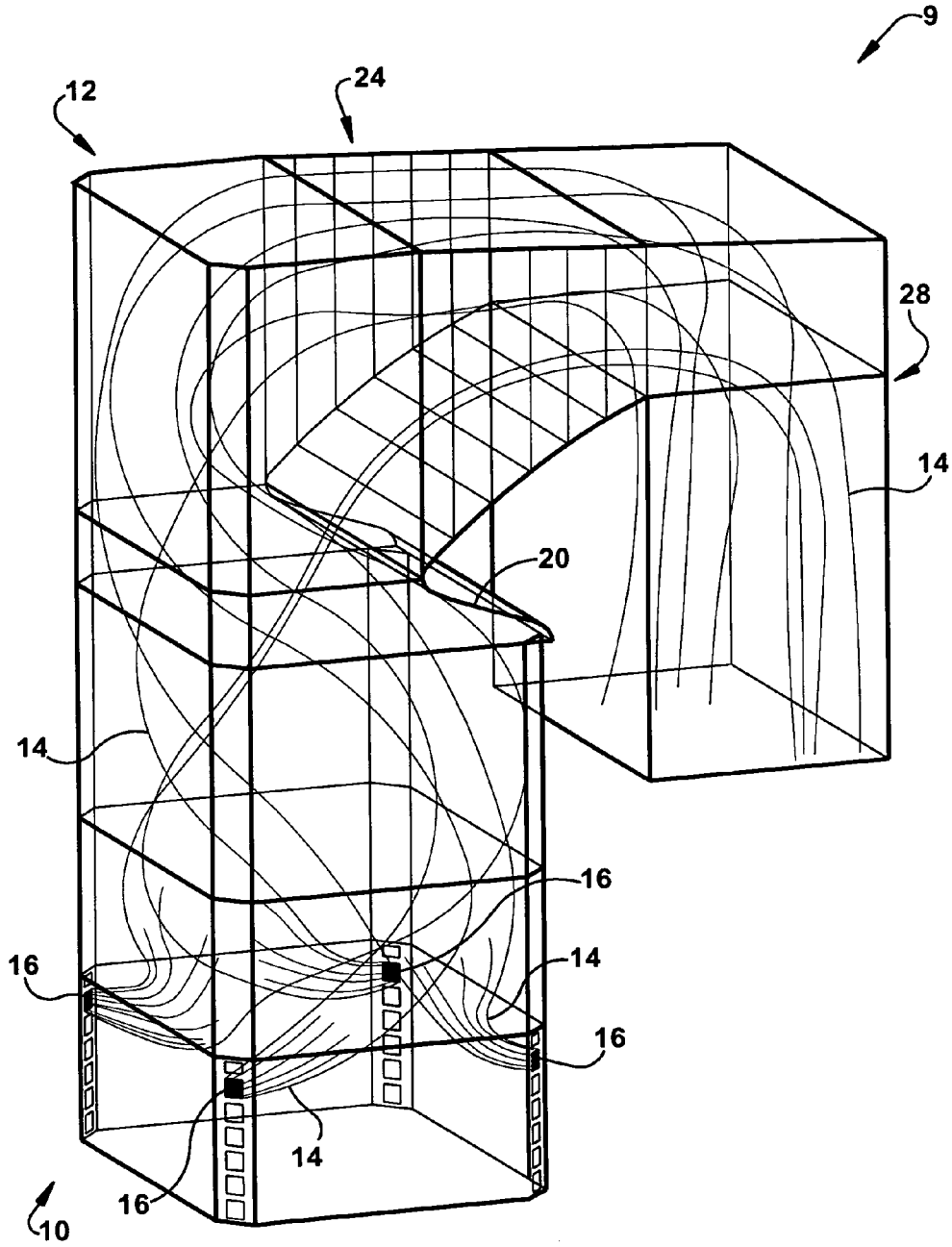
FIG. 1 is a schematic perspective representation of an exemplary tangential coal-fired boiler that includes a furnace and initial convective stages in which embodiments of the current invention may operate.

Referring now to the figures, where the various numbers represent like parts throughout the several views, FIG. 1 illustrates a schematic perspective representation of tangential coal-fired boiler 9 that includes a furnace 10 and the initial convective stages 12. Those of ordinary skill in the art will appreciate that the use of the tangential coal-fired boiler of FIG. 1 is exemplary only and that the inventive concepts expressed herein may be applied to boilers of different configurations. Further represented in FIG. 1 is a plurality of flow lines 14. The flow lines 14 represent the flow that develop within the furnace 10 and initial convective stages 12 as a result of the orientation and positioning of the burners within the furnace 10 and the imbalances of fuel and air supply to the burners. Flow lines 14 from a single level of burners, a top burner 16, are shown. The burners, including the top burners 16, may inject fuel through fuel injectors and air through air injectors from a corner of the furnace 10 to be combusted within the furnace 10.

In general, a tangentially coal-fired furnace may have four to nine levels of burners that inject fuel and air from each corner at a tangent to an imaginary circle drawn within the furnace. Note that each burner typically includes a fuel injector and an air injector. The original designers of these boilers assume that the resulting fireball would be a homogeneous structure and result in homogenous flow through the boiler 9. However, the air supply to the air injectors of the burners is regulated for the four burners on each level as a group, with no separate control provided for each air injector, which causes imbalances in the amount of air delivered to each burner. Further, fuel supply to each of the fuel injectors tend to vary from burner to burner because of the nature of conventional fuel distribution systems, which causes fuel delivery imbalances. Thus, instead of a homogeneous burning mass, the burner array produces a flow that resembles an intertwining series of rising helixes. Such flow results in multiple zones of dissimilar gas characteristics (also referred to herein as flow fields) within a cross-section of flow through the furnace 10, making the flow non-homogeneous. Thus, because of fuel and air supply inconsistencies and the orientation and positioning of the burners, flow fields may form that have differing flow and gas characteristics between them. As discussed in more detail below, these flow fields may carry over into the convective stages 12 of the boiler 9.

Between the different flow fields that form in the furnace 10, the velocities and temperatures of the gas may differ significantly. Stoichiometries between the different flow fields may vary significantly as well. For example, some of the flow fields may be fuel-lean (i.e., a condition wherein there is an excess of $O_2$ and a shortage, of CO). Other flow fields may be fuel-rich (i.e., a condition wherein there is an excess of CO and a shortage of $O_2$).

As depicted in FIG. 1, the helixes of flow lines 14 rise up the furnace 10 to a nose configuration 20, past which the flow lines 14 enter the convective stage 12 of the boiler 9. Once in the convective stage 12 of the boiler 9, the flow lines 14 turn horizontal and flow through a horizontal convective section 24. It has been discovered that the flow lines 14 tend to "straighten out" through the horizontal convective section 24 such that the helix pattern of flow is no longer observed. The "straightened out" flow lines 14 then turn downward to flow through a back pass 28 of the convective stage 12. Through the back pass 28, the flow lines 14 continue in their approximate straight path. As depicted in FIG. 1, the flow lines 14 in the back pass 28 do not illustrate a balanced or homogenous flow of gas. Instead, the flow lines 14 (and the flow fields they represent) illustrate distinct concentrations and imbalances through a cross-section of flow through the back pass 28. From the back pass 28, the flow lines 14 enter the downstream convective stages (not shown). The flow fields, that formed in the furnace 10 and through the horizontal convective section 24 and the back pass 28, continue into the later convective stages. More specifically, the differing, non-homogeneous characteristics found between the flow fields, i.e., the differing temperatures and stoichiometries, continue into the downstream convective stages.

The differing characteristics within the flow fields may lead to boiler inefficiency and slag formation in the downstream convective stages. First, as one of ordinary skill in the art would appreciate, stoichiometry and temperature imbalances within the furnace 10 and convective stage 12 cause boiler inefficiency. That is, the boiler 9 operates more efficiently if fuel supply and $O_2$ supply is balanced throughout the flow. Second, the zonal differences between the various flow fields, especially where a particular flow field is fuel-rich, may lead to increased slag formation to convective surfaces. For example, as one of ordinary skill in the art would appreciate, a flow field that is fuel-rich (i.e., high in CO) will have a lower ash softening temperature. The ash softening temperature represents the temperature at which the ash softens such that it may deposit on surfaces within the boiler to cause slag. If temperatures remain below the ash softening point, slag formation does not occur. Accordingly, having a zone or flow field in the boiler flow that is fuel-rich (i.e., reducing atmosphere) creates a zone or flow field that has a low ash softening point. This condition greatly increases the risk that the ash softening temperature will be realized such that slag forms. Further, the presence of temperature imbalances means that high temperature zones exist. The presence of high temperature zones further increases the likelihood that the ash softening temperature is reached for one or more of the flow fields within the flow through the boiler, which would cause slag to form.

It has been discovered that enhanced control of a relatively small number of the air injectors of the burners and/or air ports or ports (which are described in more detail below) in the furnace 10 may be used in conjunction with zonal monitoring along the back pass 28 to disrupt the flow fields that develop, such that a more homogeneous flow through the boiler 9 is realized. As stated, a more homogeneous flow, i.e., a flow through the furnace 10 and convective stages 12 that is generally homogenous in stoichiometry and temperature characteristics across its cross-section, would increase boiler 9 efficiency and significantly mitigate slag formation. In this manner, zones of high temperature gas and fuel-rich flow fields (both of which lead to slag formation and boiler inefficiency) may be eliminated or significantly reduced prior to their entry into the convection pass where slagging might occur.

Figure 2:
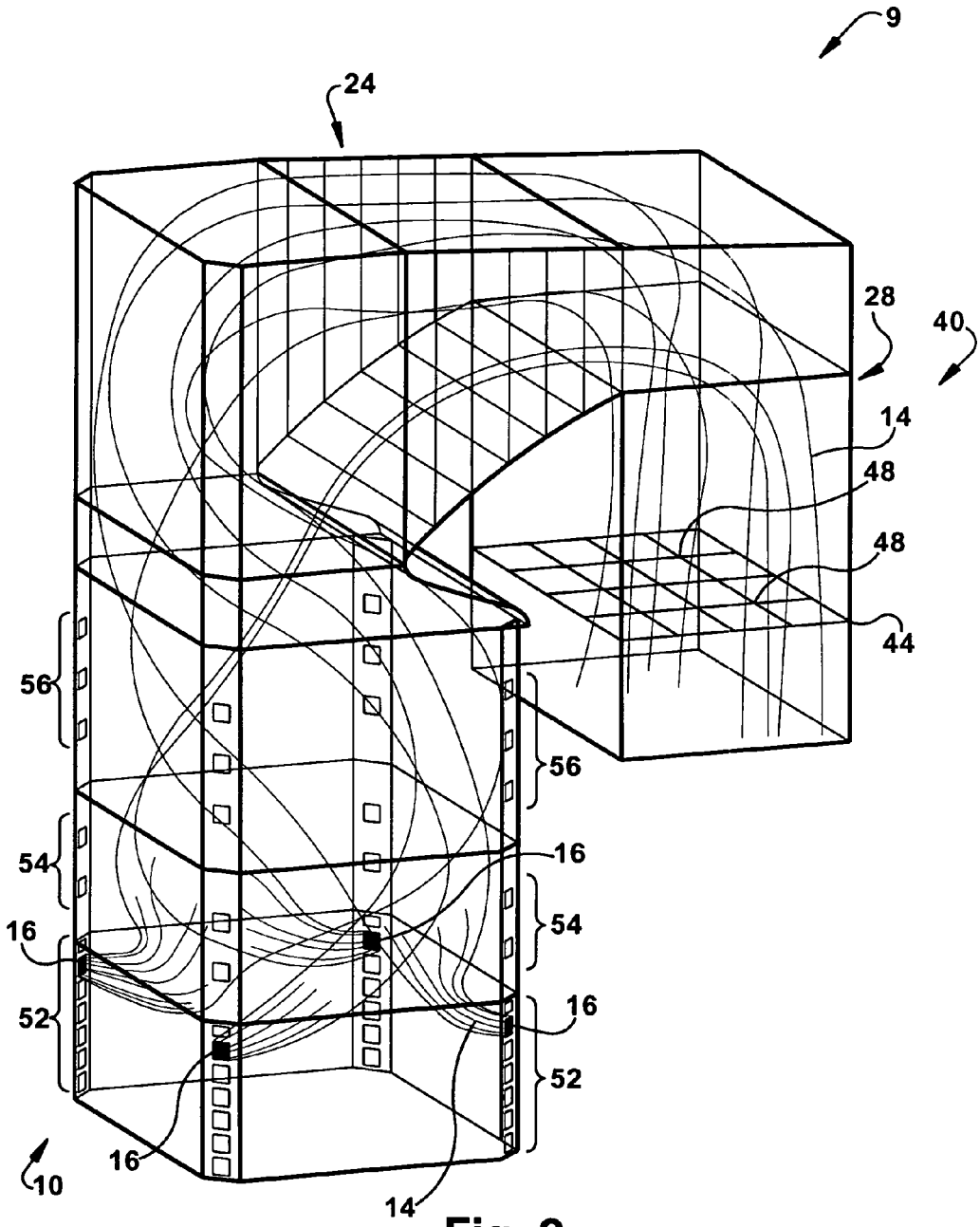
FIG. 2 is a schematic perspective representation of the exemplary tangential coal-fired boiler of FIG. 1 with an exemplary embodiment of the current invention illustrated therein.

Referring now to FIG. 2, a system 40 is illustrated for controlling a relatively small number of the air injectors of the burners and/or air ports in the furnace 10 in conjunction with zonal monitoring along the back pass 28 to disrupt the flow fields that develop such that a more homogeneous flow is realized. The system 40 is illustrated as part of the boiler 9, which may be a tangential coal-fired boiler with low-NOx burners. Those of ordinary skill in the art will appreciate that the use of the tangential coal-fired boiler with low-NOx burners is exemplary only and that the system 40 generally may be applied to boilers of different configurations.

The system 40 may include an analyzer grid 44. The analyzer grid 44 may include a grid of sensors 48 positioned along an approximate cross-section of the back pass 28. The analyzer grid 44 may include a plurality of the sensors 48, each of which may be positioned at one of the grid points such that the sensors 48 are substantially evenly spaced over the cross-section. The analyzer grid 44 may include between 6 and 24 sensors 48, though this number may increase or decrease significantly depending on the application and size of the boiler. Pursuant to methods and apparatus known in the art, each sensor 48 may provide information regarding the current level of CO, $O_2$ and/or temperature in the flow through the back pass 28 at the particular location of the sensor 48. The information obtained by the sensor 48 may be sent to a controller (not shown). In some embodiments, the controller may include an operator or person. In other embodiments, as discussed in more detail below, the controller may be a computerized operating system. As used herein, the term "analyzer grid" is defined to include any system for taking measurements of gas characteristics through an approximate cross-section of the furnace 10 or convective stage 12 of the boiler 9.

Tangential coal-fired boilers with low-NOx burners generally have between four to nine levels of burners. These burners generally include a level of top burners 52. The burner 16, discussed above, is one of the top burners 52. The top burner level 52 may include a plurality of burners stacked vertically at each corner of the furnace 9. As stated, each burner includes a fuel injector and an air injector. The furnace 9 of such a system generally may include a level of air ports or ports above the top burners 52, which is often referred to as the close-coupled overfire air injector ports ("CCOFA ports") 54. As illustrated, the CCOFA ports 54, which include an air injector, may include two vertically stacked ports in each corner of the furnace 9, though the number of ports in the level of CCOFA ports 54 may vary. The furnace 9 of such a system further may include a level of air ports above the CCOFA ports 54, which is often referred to as the separated overfire air injector ports ("SOFA ports") 56. As illustrated, the SOFA ports 56, which include an air injector, may include three vertically stacked ports in each corner of the furnace 9, though the number of ports on this level may vary. As previously described, the air supply to the burners of each level and the air ports of each level is regulated as a group, with no separate control provided for each burner/port, which causes imbalances in the amount of air delivered by each. Further, in conventional systems, the direction that the air injectors points (whether it be an air injector in one of the burners or one of the air ports) is not able to be manipulated or varied.

The system 40 further may include one or more air injectors that have enhanced controllability. The air injector with enhance controllability may be located in any burner or port. As used herein, enhanced controllability means that the direction that the air injector points is able to manipulated or controlled. For example, the air injector may be provided with a tilt function, which would allow an operator to control the air injector in the up and down (vertical) direction. The air injector also may be provided with a yaw function, which would allow an operator to control the air injector in the side-to-side (horizontal) direction. In some embodiments, enhanced controllability further may include control of the amount of air passing through the air injector. That is, the amount of air passing through the air injector may be increased or decreased by an operator. As one of ordinary skill in the art would appreciate, enhanced controllability of the air injectors, as described herein, may be achieved with conventional systems and methods.

As described, it has been discovered that enhanced controllability of a relatively small number of the air injectors of the burners or ports in the furnace 10 may be used in conjunction with zonal monitoring by the analyzer grid 44 along the back pass 28 to disrupt the flow fields that develop such that a more homogeneous flow through the boiler 9 is realized. This means that significant mitigation of the non-homogenous flow through the convective stages 22 may be realized through having a relatively limited number of air injectors with enhanced controllability. In some embodiments, for example, 30% or less of the air injectors within the boiler may be provided with enhanced controllability for significant beneficial results to be realized. In other embodiments, this percentage may be 15% or less, as describe in the example below.

For example, in some exemplary embodiments, the system 40 may include enhanced controllability for: 1) two of the air injectors within the SOFA port 56 level; two of the air injectors within the CCOFA port 54 level; and two of the air injectors within the top burner 52 level. The two air injectors within each of these levels may be positioned such that they are in opposite corners from each other. In other embodiments, for example, only four of the air injectors (two within the SOFA port 56 level and two within the CCOFA port 54 level) are automated with enhanced controllability. If four air injectors are provided with enhanced controllability, this may mean, for example, that in a boiler with 48 burners only 12 control circuits may be necessary (i.e., four air injectors, each with control circuits for tilt, yaw, and air quantity controls equals 12 control circuits). The number of control circuits may be further decreased if the enhanced controllability is provided without all three of the tilt, yaw, and air quantity variables.

Thus, the discovery that the enhanced control of a limited number of air injectors may have a significant homogenizing effect on boiler flow is significant in that it allows the advantages of a homogeneous flow to be realized in a cost effective manner in both new and existing boilers. That is, an element of the disclosed invention is the discovery that the exit gas conditions from a series of burners can be optimized through varying a minimal number of air injectors above them. In existing boilers 9, thus, there will be no need to retrofit all of the burners and/or ports with individual air controls, which would be a costly undertaking. More specifically, it is not necessary to adjust all burners and/or ports individually to obtain the desired balance of exit gas conditions. Since few existing tangential boilers have such individual controls on burners or ports, this approach would be substantially cost prohibitive in retrofit situations.

In operation, the controller may control the air injectors with enhanced controllability in response to the data gathered by the grid analyzer 44. More specifically, the grid analyzer 44 may provide real time data concerning the CO, $O_2$ and/or temperature measurements for each of the sensors 48 locations across the analyzer grid 44 to the controller. Each sensor 48 may take measurements at short intervals, such as every 0.1 to 1.0 seconds. This data may provide a cross-sectional analysis of the flow through the boiler 9, which may identify the non-homogenous aspects of the flow, such as zones or flow fields constituting areas of fuel-rich flow, areas of fuel-lean flow, and/or areas of high and low temperatures. Based on this data, the controller may control or vary the tilt, yaw and/or the air quantity controls for the air injectors with enhanced controllability to disrupt the flow fields (i.e., homogenize the flow) and, thusly, balance stoichiometries, eliminate zones of high carbon monoxide, eliminate high/low temperature zones and/or improve or reduce carbon in ash levels, which may improve the overall efficiency of the boiler and significantly reduce slag build-up through the convective section of the boiler.

In general, the control of the air injectors with enhanced controllability to homogenize the boiler flow may be accomplished through a combination of computational fluid dynamics modeling and close-loop iterative control processes. More specifically, initial settings and adjustments may be made based upon predictive flow models. The effect of these adjustments then may be measured by the analyzer grid 44 and the information transferred to the controller. The control then may analyze the information to determine the effect that the initial adjustments had on the flow through the boiler 9. Based the effect that the initial adjustments had on the boiler flow and further computational fluid dynamics modeling, the controller may make further adjustments to the settings of the air injectors with enhanced controllability to further homogenize the boiler flow. This process may continue until the boiler flow attains a desired homogeneous state. In this manner, the sensors 48 of the grid analyzer 44 may produce boiler flow data that will permit the controller and its closed-loop control system to make adjustments within the furnace to correct for conditions that lead to inefficient boiler operation and fouling, while continuing to maintain minimum NOx conditions. The system 40 may function regardless of load level or burner tilt. Subsequent adjustments may be made as operating conditions vary within the boiler 9 change such that desired homogeneous flow characteristics are maintained.

As one of ordinary skill in the art, the controller may comprise a computer operating system, which may be any appropriate high-powered solid-state switching device. The computer operating system may be a computer; however, this is merely exemplary of an appropriate high-powered control system, which is within the scope of the application. For example, but not by way of limitation, the computer operating system may include at least one of a silicon controlled rectifier (SCR), a thyristor, MOS-controlled thyristor (MCT) and an insulated gate bipolar transistor. The computer operating system also may be implemented as a single special purpose integrated circuit, such as ASIC, having a main or central processor section for overall, system-level control, and separate sections dedicated performing various different specific combinations, functions and other processes under control of the central processor section. It will be appreciated by those skilled in the art that the computer operating system also may be implemented using a variety of separate dedicated or programmable integrated or other electronic circuits or devices, such as hardwired electronic or logic circuits including discrete element circuits or programmable logic devices, such as PLDs, PALs, PLAs or the like. The computer operating system also may be implemented using a suitably programmed general-purpose computer, such as a microprocessor or microcontrol, or other processor device, such as a CPU or MPU, either alone or in conjunction with one or more peripheral data and signal processing devices. In general, any device or similar devices on which a finite state machine capable of implementing the process described above may be used as the computer operating system. As shown a distributed processing architecture may be preferred for maximum data/signal processing capability and speed. The computer operating system further may be linked to and control the operation of the air injectors with enhance controllability (i.e., control the tilt, yaw, air quantity settings or other settings) and the other mechanical systems of the system 40.

From the above description of preferred embodiments of the invention, those skilled in the art will perceive improvements, changes and modifications. Such improvements, changes and modifications within the skill of the art are intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

We claim:

1. A system for reducing fouling and improving efficiency in a coal-fired power plant, comprising:

an analyzer grid, the analyzer grid comprising a plurality of sensors that measure gas characteristics through an approximate cross-section of a flow through a boiler of the coal-fired power plant;

a plurality of air injectors with enhanced controllability;

means for analyzing the measurements of the gas characteristics; and means for controlling the air injectors with enhanced controllability;

wherein the air injectors with enhanced controllability each comprises an air injector with yaw control;

wherein the air injectors with enhanced controllability comprise two of the air injectors within a separated overfire air injector port level and two of the air injectors within a close-coupled overfire air injector port level; and wherein the air injectors of the separated overfire air injector port level and the close-coupled overfire air injector port level are located at the corners of a substantially rectangular furnace, and the two air injectors with enhanced controllability within each of the port levels comprise the air injectors positioned on opposite corners of the rectangle.

2. The system of claim 1, wherein the analysis of the measurements of the gas characteristics comprises analyzing the measurements to determine zones of non-homogeneous flow.

3. The system of claim 2, further comprising means for controlling the air injectors with enhanced controllability so that the zones of non-homogeneous flow are disrupted and a more homogeneous flow throughout the cross-section of flow is realized;

wherein the control of the air injectors with enhanced controllability is based on the analysis of the measurements of gas characteristics.

4. The system of claim 1, wherein the gas characteristics measured by the sensors include at least one of CO, $O_2$ and temperature levels.

5. The system of claim 1, wherein summing the number of air injectors with enhanced controllability with a number of air injectors without enhanced controllability provides a total number of air injectors; and wherein the percentage of the total number of air injectors that are air injectors with enhanced controllability is less than or equal to about 15%.

6. The system of claim 4, wherein the analysis of the measurements of the gas characteristics comprises analyzing the measurements to determine the extent to which zones within the cross-section of flow have differing CO, $O_2$, and temperature levels.

7. The system of claim 6, wherein controlling the air injectors with enhanced controllability based on the analysis comprises controlling the air injectors with enhanced controllability such that the differing CO, $O_2$, and temperature levels between the zones of the cross-section of flow are minimized.

8. The system of claim 1, wherein the air injectors with enhanced controllability each comprises an air injector with tilt control.

9. The system of claim 1, wherein the coal-fired power plant comprises a tangential coal-fired power plant.

10. The system of claim 1, wherein the analyzer grid is positioned in a convective stage of a boiler and comprises sensors that are substantially evenly spaced over the approximate cross-section of flow.

11. The system of claim 1, wherein the air injectors with enhanced controllability comprise two of the air injectors of two ports within a separated overfire air injector port level, two of the air injectors within a close-coupled overfire air injector port level, and two of the air injectors within a top burner level.

12. The system of claim 1, wherein summing the number of air injectors with enhanced controllability with a number of air injectors without enhanced controllability provides a total number of air injectors; and wherein the percentage of the total number of air injectors that are air injectors with enhanced controllability is less than or equal to about 30%.

* * * * *